US012318055B2

(12) United States Patent
Jeong et al.

(10) Patent No.: US 12,318,055 B2
(45) **Date of Patent: *Jun. 3, 2025**

(54) SHOE CARE APPARATUS AND METHOD OF CONTROLLING THE SAME

(71) Applicant: SAMSUNG ELECTRONICS CO., LTD., Suwon-si (KR)

(72) Inventors: Heemoon Jeong, Suwon-si (KR); Minsoo Kim, Suwon-si (KR); Joongwon Na, Suwon-si (KR); Kookjeong Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 682 days.

This patent is subject to a terminal disclaimer.

(21) Appl. No.: 17/560,677

(22) Filed: Dec. 23, 2021

(65) Prior Publication Data

US 2022/0338711 A1 Oct. 27, 2022

Related U.S. Application Data

(63) Continuation of application No. PCT/KR2021/013012, filed on Sep. 24, 2021.

(30) Foreign Application Priority Data

Apr. 22, 2021 (KR) ..... 10-2021-0052577
Jul. 12, 2021 (KR) ..... 10-2021-0090703

(51) Int. Cl.
*A47L 23/20* (2006.01)
*A47L 23/18* (2006.01)

(52) U.S. Cl.
CPC ..... *A47L 23/205* (2013.01); *A47L 23/18* (2013.01)

(58) Field of Classification Search
CPC ..... A47L 23/205; A47L 23/18
(Continued)

(56) References Cited

U.S. PATENT DOCUMENTS 1,678,139 A * 7/1928 Furber ..... A43D 11/14 12/146 D
3,078,526 A * 2/1963 Caruso ..... A61L 2/24 194/242

(Continued)

FOREIGN PATENT DOCUMENTS

CN 102517861 6/2012
EP 4238474 A1 * 9/2023 ..... A47L 23/18

(Continued)

OTHER PUBLICATIONS

PCT/ISA/210 dated Jan. 20, 2022 in International Patent Application No. PCT/KR2021/013012 (3 pages).

(Continued)

*Primary Examiner* — Stephen M Gravini
(74) *Attorney, Agent, or Firm* — STAAS & HALSEY LLP

(57) ABSTRACT

A shoe care apparatus includes a main body, a care room provided in the main body and configured to accommodate shoes, a machine room in the main body and configured to accommodate a heat pump device including an evaporator and a condenser, and a blower fan configured to allow air circulating through the care room and the machine room to be blown. The show care apparatus further includes a first circulation passage through which air discharged from the care room is supplied to the care room by passing through the evaporator and the condenser and a second circulation passage through which air discharged from the care room is supplied to the care room by passing through the evaporator and bypassing the condenser. The shoe care apparatus also (Continued)

including a first damper configured to open and close the second circulation passage.

15 Claims, 10 Drawing Sheets

(58) Field of Classification Search
USPC ..... 34/106
See application file for complete search history.

(56) References Cited

U.S. PATENT DOCUMENTS

| | | | | |
|---|---|---|---|---|
| 5,546,678 | A * | 8/1996 | Dhaemers | F26B 21/02 34/224 |
| 6,766,594 | B2 * | 7/2004 | DuRapau | D06F 59/04 34/104 |
| 7,921,578 | B2 * | 4/2011 | McAllister | D06F 35/00 34/597 |
| 8,453,720 | B2 | 6/2013 | Song et al. | |
| 8,984,766 | B2 * | 3/2015 | Williams | F26B 20/00 34/381 |
| 9,103,588 | B2 * | 8/2015 | Williams | F26B 25/08 |
| 9,249,538 | B2 * | 2/2016 | Bison | D06F 58/24 |
| 9,869,052 | B2 | 1/2018 | Liang et al. | |
| 9,976,242 | B2 | 5/2018 | Ryoo et al. | |
| 9,976,249 | B2 | 5/2018 | Lv et al. | |
| 10,174,452 | B2 * | 1/2019 | Choi | D06F 58/10 |
| 10,197,332 | B2 * | 2/2019 | Hinkey | A47L 23/205 |
| 10,544,540 | B2 | 1/2020 | Lee | |
| 10,724,744 | B2 | 7/2020 | Uselton | |
| 11,085,143 | B2 | 8/2021 | Wakizaka et al. | |
| 11,408,679 | B2 * | 8/2022 | Ohnari | F26B 25/008 |
| 2009/0320314 | A1 | 12/2009 | Jo et al. | |
| 2010/0005681 | A1 | 1/2010 | Jo et al. | |
| 2018/0066893 | A1 | 3/2018 | Bing et al. | |
| 2018/0312028 | A1 | 11/2018 | Rippel et al. | |
| 2022/0338711 | A1 * | 10/2022 | Jeong | F26B 21/02 |
| 2024/0122442 | A1 * | 4/2024 | Na | F28F 9/0131 |

FOREIGN PATENT DOCUMENTS

| | | | | |
|---|---|---|---|---|
| EP | 4335350 | A1 * | 3/2024 | A47L 23/18 |
| JP | 2004-239549 | | 8/2004 | |
| JP | 2007-301220 | | 11/2007 | |
| JP | 5625883 | | 11/2014 | |
| JP | 6069797 | | 2/2017 | |
| KR | 95-24772 | | 9/1995 | |
| KR | 20-0250736 | | 11/2001 | |
| KR | 10-0459193 | | 12/2004 | |
| KR | 20-0433313 | | 12/2006 | |
| KR | 10-0681425 | | 2/2007 | |
| KR | 10-0696397 | | 3/2007 | |
| KR | 10-0795207 | | 1/2008 | |
| KR | 10-0808199 | B1 | 2/2008 | |
| KR | 10-0826537 | | 5/2008 | |
| KR | 10-0840737 | | 6/2008 | |
| KR | 10-2011-0098092 | | 9/2011 | |
| KR | 10-1069827 | B1 | 10/2011 | |
| KR | 20-0457168 | | 12/2011 | |
| KR | 10-2012-0015012 | | 2/2012 | |
| KR | 10-2013-0010177 | | 1/2013 | |
| KR | 10-2013-0018068 | | 2/2013 | |
| KR | 10-2013-0026835 | | 3/2013 | |
| KR | 10-2013-0035627 | | 4/2013 | |
| KR | 10-1265621 | | 5/2013 | |
| KR | 10-1318056 | | 10/2013 | |
| KR | 10-2014-0127986 | | 11/2014 | |
| KR | 10-1594260 | | 2/2016 | |
| KR | 10-1613963 | B1 | 4/2016 | |
| KR | 10-2016-0059982 | | 5/2016 | |
| KR | 10-1632013 | | 6/2016 | |
| KR | 10-1636711 | | 7/2016 | |
| KR | 10-1661393 | | 9/2016 | |
| KR | 10-1711869 | | 3/2017 | |
| KR | 10-2017-0110120 | | 10/2017 | |
| KR | 10-1889821 | | 8/2018 | |
| KR | 10-2004349 | | 7/2019 | |
| KR | 10-2020-0002371 | | 1/2020 | |
| KR | 10-2020-0002725 | | 1/2020 | |
| KR | 10-2020-0130463 | | 11/2020 | |
| KR | 10-2021-0016968 | | 2/2021 | |
| KR | 10-2021-0016974 | | 2/2021 | |
| KR | 10-2021-0017015 | | 2/2021 | |
| KR | 10-2021-0030856 | | 3/2021 | |
| KR | 10-2230674 | | 3/2021 | |
| KR | 10-2291415 | | 8/2021 | |
| KR | 10-2310173 | | 10/2021 | |
| KR | 10-2022-0163193 | | 12/2022 | |
| KR | 20230018247 | A * | 2/2023 | |
| WO | 2022/255723 | | 12/2022 | |
| WO | WO-2023008786 | A1 * | 2/2023 | A47L 23/18 |

OTHER PUBLICATIONS

Extended European Search Report dated May 28, 2024 for European Application No. 21938026.8.
International Search Report dated Nov. 2, 2022 for International Application No. PCT/KR2022/010205.
U.S. Appl. No. 18/534,213, filed Dec. 8, 2023, Joongwon Na et al.
Korean Office Action issued in counterpart of Korean Application No. 10-2021-0090703 dated Mar. 20, 2025.
European Intention to Grant issued in counterpart European Application No. 21 936 026.8 dated Jan. 27, 2025.

* cited by examiner

SHOE CARE APPARATUS AND METHOD OF CONTROLLING THE SAME

CROSS-REFERENCE TO RELATED APPLICATION

This application is a continuation application, under 35 U.S.C. § 111(a), of International Patent Application No. PCT/KR2021/013012 filed on Sep. 24, 2021 which claims the benefit of Korean Patent Application No. 10-2021-0052577 filed on Apr. 22, 2021 and Korean Patent Application No. 10-2021-0090703 filed on Jul. 12, 2021. The contents of PCT Application No. PCT/KR2021/013012 filed on Sep. 24, 2021 which claims the benefit of Korean Patent Application No. 10-2021-0052577 and Korean Patent Application No. 10-2021-0090703 are incorporated by reference herein in their entirety.

BACKGROUND

Field

The disclosure relates to a shoe care apparatus and a method of controlling the same, and more specifically, to a shoe care apparatus capable of controlling the temperature of air supplied into a care room and a method of controlling the same.

Description of Related Art

In general, a shoe care apparatus is an apparatus that cares for shoes, such as by drying or cleaning shoes, and removing odors from shoes.

The shoe care apparatus may be provided with devices forming a heat pump cycle, such as an evaporator, a condenser, and a compressor therein. In the drying and/or cooling stroke, air in the care room may flow out of the care room, and may be cooled and dehumidified through the evaporator and the condenser, and then the cooled and dehumidified air may return to the care room. In other words, air circulates in a passage passing through a care room and a machine room.

In a circulation method, since air is heated while continuously circulating inside the shoe care apparatus, continuous heat accumulation occurs and it may be difficult to cool and dehumidify the air supplied to the care room. Accordingly, in recent years, there is a demand to improve the performance of a heat pump cycle in which the air flowing into the care room is cooled and dehumidified by preventing continuous heat accumulation.

SUMMARY

Therefore, it is an aspect of the disclosure to provide a shoe care apparatus with an increased efficiency of a heat pump cycle and a method of controlling the same.

It is another aspect of the disclosure to provide a shoe care apparatus capable of smoothly cooling and dehumidifying air supplied to a care room, and a method of controlling the same.

It is another aspect of the disclosure to provide a shoe care apparatus capable of improving the dehumidification performance, and a method of controlling the same.

It is another aspect of the disclosure to provide a shoe care apparatus capable of providing a variety of courses to meet the needs of users, and a method of controlling the same.

According to an aspect of the disclosure, there is provided a shoe care apparatus including: a main body; a care room provided inside the main body and configured to accommodate shoes; a machine room provided inside the main body and configured to accommodate a heat pump device including an evaporator and a condenser; a blower fan configured to allow air circulating through the care room and the machine room to be blown; a first circulation passage through which air discharged from the care room is supplied to the care room by passing through the evaporator and the condenser; a second circulation passage through which air discharged from the care room is supplied to the care room by passing through the evaporator and bypassing the condenser; and a first damper configured to open and close the second circulation passage.

The shoe care apparatus may further include: a communication hole provided in one wall of the main body to communicate an outside of the main body with the machine room; an inlet through which air introduced into the machine room through the communication hole flows to the condenser; and an outlet formed through which the air introduced through the inlet passes through the condenser and then flows to the machine room, in which air discharged through the outlet is discharged to the outside of the main body through the communication hole.

The shoe care apparatus may further include at least one of a second damper configured to open and close the inlet or a third damper configured to open and close the outlet.

The shoe care apparatus may further include a fourth damper arranged between the evaporator and the condenser on the first circulation passage.

The shoe care apparatus may further include a controller configured to control an operation of the first damper and an operation of the fourth damper.

The controller may be configured to: control an operation of the first damper and an operation of the fourth damper such that the second circulation passage is closed when the first circulation passage is opened; and control an operation of the first damper and an operation of the fourth damper such that the second circulation passage is opened when the first circulation passage is closed.

The controller may be configured to control an operation of the first damper and an operation of the fourth damper based on at least one of an operating frequency of the compressor of the heat pump device and a temperature of air supplied to the care room.

The controller may be configured to control an operation of the second damper and an operation of the third damper based on the temperature of the air supplied to the care room.

According to another aspect of the disclosure, there is provided a method of controlling a shoe care apparatus that operates in a first mode in which air having passed through a condenser of a heat pump device is supplied to a care room or a second mode in which air having bypassed the condenser is supplied to the care room, the method including: in response to the shoe care apparatus being operating in the first mode, opening a first circulation passage through which air discharged from the care room is supplied to the care room by passing through an evaporator of the heat pump device and the condenser; and in response to the shoe care apparatus being operating in the second mode, opening a second circulation passage through which air discharged from the care room is supplied to the care room by passing through the evaporator and bypassing the condenser.

The method may further include determining an operation mode of the shoe care apparatus based on at least one of an operating frequency of the compressor device and a temperature of air supplied to the care room.

The determining of an operation mode of the shoe care apparatus based on at least one of an operating frequency of the compressor device and a temperature of air supplied to the care room may include, based on the operating frequency of the compressor being less than or equal to a preset frequency and the temperature of air supplied to the care room being higher than or equal to a set temperature, while the shoe care apparatus is operating in the first mode, changing the operation mode of the shoe care apparatus into the second mode.

The method may further include operating the shoe care apparatus in one of the first mode and the second mode based on a user input.

The operating of the shoe care apparatus in one of the first mode and the second mode based on the user input may include, based on a first user input being received, controlling the shoe care apparatus to operate in the first mode for a first preset time and then operate in the second mode for a second preset time.

The operating of the shoe care apparatus in one of the first mode and the second mode based on the user input may include, based on a first user input being received, controlling the shoe care apparatus to alternately operate in the first mode and in the second mode.

The operating of the shoe care apparatus in one of the first mode and the second mode based on the user input may include, based on a first user input being received, controlling the shoe care apparatus to operate only in the second mode for a preset time.

According to an aspect of the disclosure, the shoe care apparatus and the method of controlling the same can provide various courses according to the user's request.

DETAILED DESCRIPTION

Figure 1:
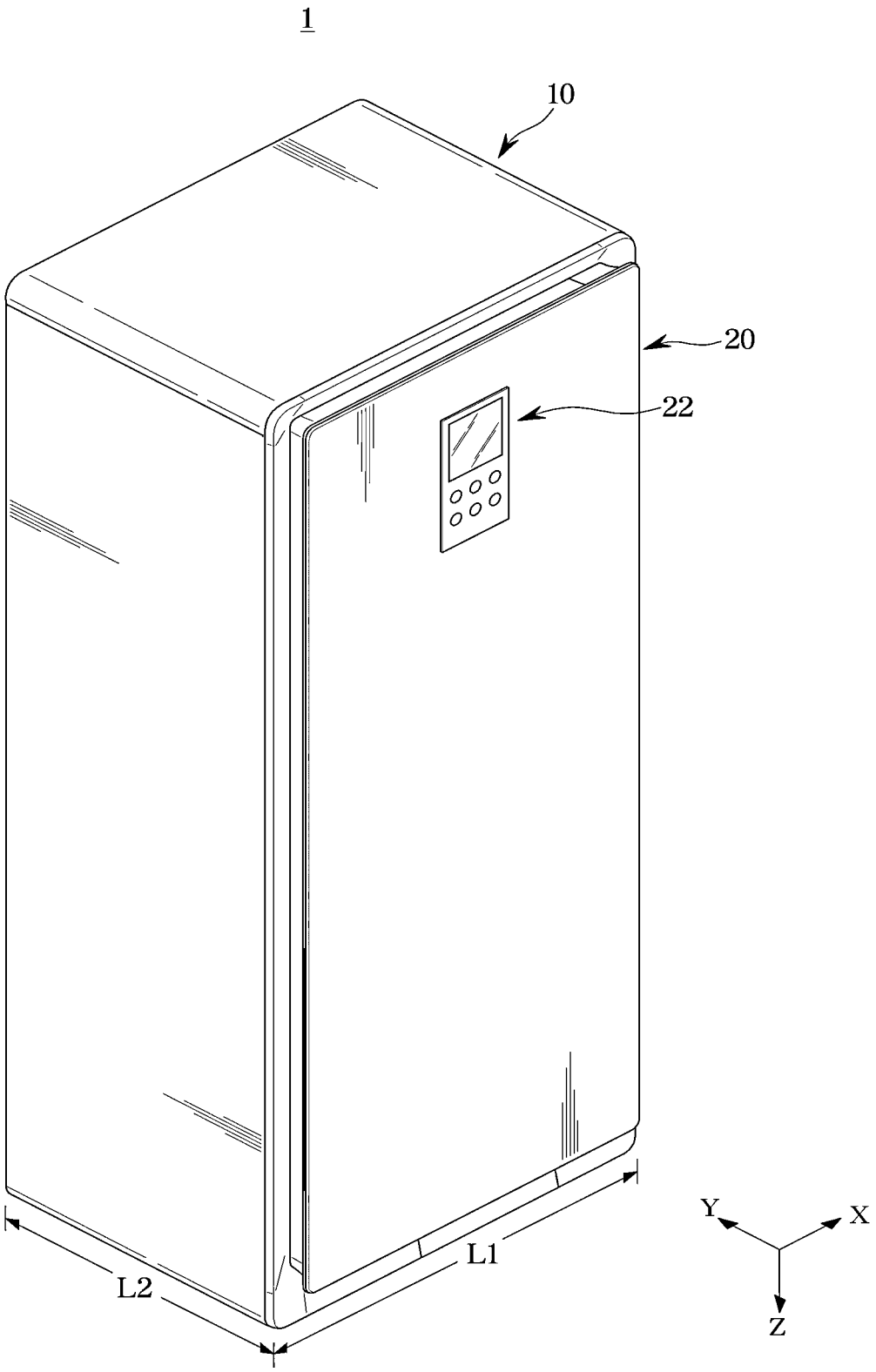
FIG. 1 is a perspective view illustrating a shoe care apparatus according to an embodiment of the disclosure.

As is apparent from the above, according to an aspect of the disclosure, the shoe care apparatus and the method of controlling the same can smoothly cool and dehumidifying air by enhancing the efficiency of a heat pump cycle through a bypass passage.

According to an aspect of the disclosure, the shoe care apparatus and the method of controlling the same can maintain the dehumidifying performance even when the outdoor temperature of the shoe care apparatus is high and also can prevent the failure of the heat pump device.

The embodiments set forth herein and illustrated in the configuration of the disclosure are only preferred embodiments, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "— and/or —," or the like.

The terms "front", "rear", "left", and "right" as herein used are defined with respect to the drawings, but the terms may not restrict the shape and position of the respective components.

Figure 2:
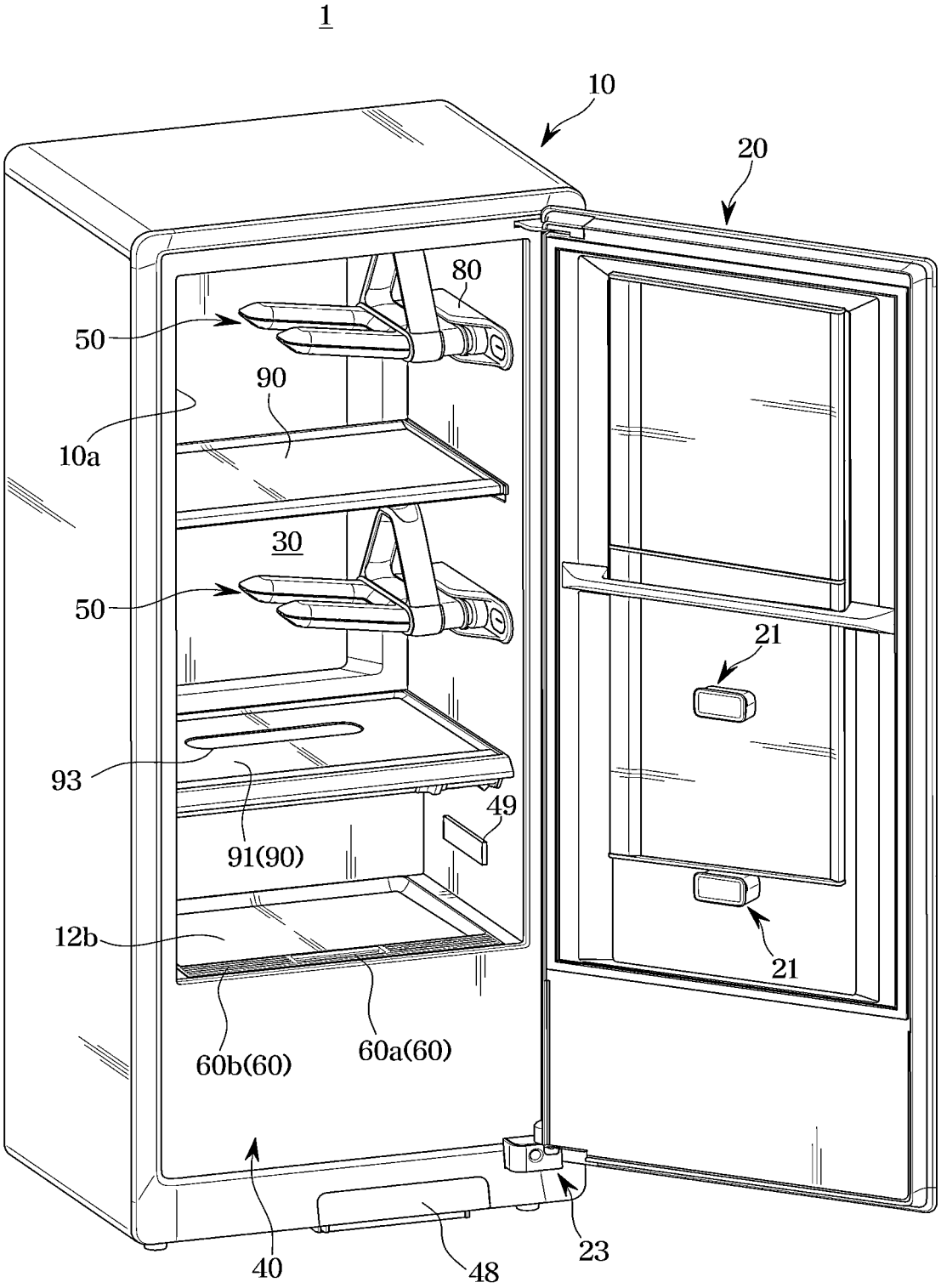
FIG. 2 is a perspective view illustrating a state in which a door is opened in the shoe care apparatus shown in FIG. 1.

Referring to FIGS. 1 and 2, the direction in which a door 20 of a shoe care apparatus 1 is installed is defined as a forward direction, based on which rear, left and right sides and upper and lower sides may be defined.

Hereinafter, an embodiment according to the disclosure will be described in detail with reference to the accompanying drawings.

Figure 3:
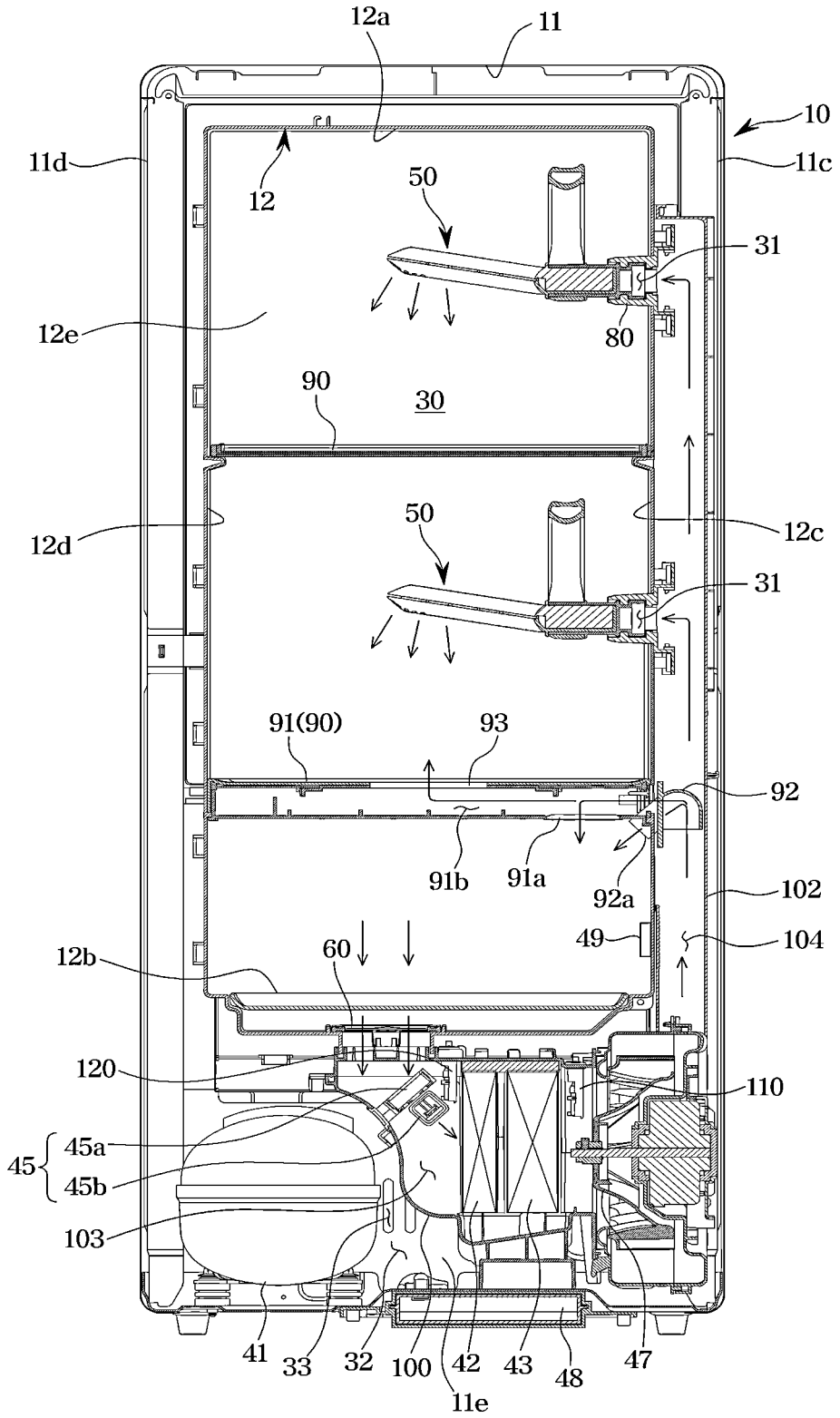
FIG. 3 is a front cross-sectional view illustrating the shoe care apparatus shown in FIG. 1.

FIG. 1 is a perspective view illustrating a shoe care apparatus according to an embodiment of the disclosure. FIG. 2 is a perspective view illustrating a state in which a door is opened in the shoe care apparatus shown in FIG. 1. FIG. 3 is a front cross-sectional view illustrating the shoe care apparatus shown in FIG. 1.

Referring to FIGS. 1 to 3, the shoe care apparatus 1 may include a main body 10 forming the external appearance and a door 20 rotatably coupled to the main body 10.

The main body 10 may be provided in a rectangular parallelepiped shape with an open front side. An opening 10*a* may be formed in the open front side of the main body 10. The door 20 may be rotatably coupled to the main body 10 to open and close the open front side of the main body 10. The door 20 may be coupled to the main body 10 by a hinge 23.

The main body 10 may be formed such that a front surface extending in a first direction X has a length different from that of a side surface extending in a second direction Y. That is, the front surface of the main body 10 may have a length L1 longer than a length L2 of the side surface of the main body 10. Such a configuration enables the shoe care apparatus 1 to be easily installed even in a narrow entrance hall. The length of the front surface of the main body 10 may be defined as a first length L1 and the length of the side surface of the main body 10 may be defined as a second length L2.

The door 20 may include a control panel 22 provided on a front and/or upper surface of the door 20. The control panel 22 may receive various commands from the user. In addition, the control panel 22 may display various pieces of information regarding the operation of the shoe care apparatus 1. For example, the user may use the control panel 22 to select the type of shoes to be cared for, and set an appropriate care course for the shoes.

The control panel 22 may include a display for displaying information regarding the operation of the shoe care apparatus 1. In addition, the control panel 22 may include at least one of a button or a touch screen.

The door 20 may include a hanging member 21. The hanging member 21 may be provided on one side of the door 20 facing the inside of a care room 30, and may be provided in at least one unit thereof. The care room 30 may also be referred to as a compartment 30, care area 30, a treatment area 30, or care space 30. The hanging member 21 may be used for hanging a handle 55 of a cradle 50. The hanging member 21 may facilitate storage of the cradle 50. The hanging member 21 may be used for other uses.

The main body 10 may include an outer case 11 and an inner case 12 arranged inside the outer case 11. The care room 30 may be formed inside the main body 10. For example, the inner case 12 may form the care room 30. The care room 30 may be provided therein with the cradle 50 on which shoes may be held. The inner case 12 may be referred to as a case.

The care room 30 may form a space in which shoes are accommodated. The care room 30 may be formed by an upper surface 12*a*, a lower surface 12*b*, a left surface 12*c*, a right surface 12*d*, and a rear surface 12*e* of the inner case 12. Shoes may be accommodated in the care room 30 and cared. The upper surface 12*a*, the lower surface 12*b*, the left surface 12*c*, the right surface 12*d*, and the rear surface 12*e* of the inner case 12 may form an upper wall 12*a*, a lower wall 12*b*, a left wall 12*c*, a right wall 12*d*, and a rear wall 12*e* of the inner case 12.

The cradle 50 and a mounting rail 80 may be provided in the care room 30. The cradle 50 and the mounting rail 80 may be installed on the left surface 12*c* or the right surface 12*d* of the inner case 12. That is, the cradle 50 may be installed such that the side of the shoe is visible when viewed from the front of the shoe care apparatus 1. To this end, the length of the side surface of the main body 10 may be formed shorter than the length of the front surface of the main body 10. However, the positions of the cradle 50 and the mounting rail 80 are not limited to those illustrated above.

The cradle 50 may be provided in at least one unit thereof. The cradle 50 may be provided in a shape to be inserted into the shoe. In addition, the cradle 50 is detachable from the care room 30. That is, the cradle 50 may be coupled to the mounting rail 80 provided on the side surface of the care room 30, and may be separated from the mounting rail 80. For example, the cradle 50 may be inserted into the mounting rail 80 along the second direction Y. Because the cradle 50 is detachably provided, the space in the care room 30 may be efficiently used according to the size of the shoe.

The shoe care apparatus 1 may include an air outlet 31 and an air inlet 60. The air outlet 31 may be formed in the sidewall of the inner case 12. For example, the air outlet 31 may be formed on the left surface 12*c* of the care room 30. The air outlet 31 may be provided in plural. The air outlet 31 may allow air that has passed through a duct 100 to flow into the care room 30. In other words, inside the duct 100, air cooled and dehumidified by an evaporator 42 may flow to a condenser 43, and the air may be heated by the condenser 43 and flow into the care room 30 through the air outlet 31.

The air inlet 60 may be formed on one side surface of the inner case 12. For example, the air inlet 60 may be formed on the lower surface 12*b* of the inner case 12. Specifically, the air inlet 60 may be arranged on a front portion of the lower surface 12*b*. Air in the care room 30 may be introduced into the duct 100 through the air inlet 60. The air inlet 60 may include a central hole 60*a* and a grille 60*b* including a plurality of side holes.

The shoe care apparatus 1 may include a machine room 32, a condenser 43, a compressor 41, an evaporator 42, and a communication hole 33.

The machine room 32 may be provided at one side of the care room 30. The machine room 32 may be referred to as compartment 32, machine area 32, and machine space 32. For example, the machine room 32 may be provided below the care room 30. At least a portion of the duct 100 may be accommodated in the machine room 32. A heat pump device 40 including the compressor 41, the expander 44, the evaporator 42, and the condenser 43 may be arranged in the machine room 32. The machine room 32 may accommodate the compressor 41, the expander 44, the evaporator 42, and the condenser 43. In addition, a sterilizing device 49 may be provided in the care room 30 or in the machine room 32. In FIGS. 2 and 3, the sterilization device 49 is illustrated as being provided inside the care room 30.

Air inside the machine room 32 may communicate with the air outside of the shoe care apparatus 1 through the communication hole 33. The communication hole 33 may be provided in a rear portion of the machine room 32. The communication hole 33 may be provided in a rear wall of the main body 10. For example, the communication hole 33 may be provided in a rear wall 11*e* of the outer cabinet 11. However, the disclosure is not limited thereto, and the communication hole 33 may be provided at various positions as long as it can communicate the machine room 32 with the outside of the main body 10. For example, the communication holes may be formed on sidewalls 11*c* and 11*d* of the outer cabinet 11.

The duct 100 may be provided at one side of the care room 30. For example, the duct 100 may be arranged on the left wall 12*c* and/or the right wall 12*d* below the care room 30. In addition, the duct 100 may be provided at one side of the machine room 32. For example, the duct 100 may be arranged on an upper side of the machine room 32. In the duct 100, the evaporator 42, the condenser 43, the deodorizing device 45, the duct 100, a blower fan 47, a first temperature sensor 110 and a second temperature sensor 120 may be provided.

The compressor 41, the evaporator 42, the condenser 43, and the expander 44 (to be described below) may be defined as the heat pump device 40. A refrigerant may flow through the compressor 41, the evaporator 42, the condenser 43, and the expander 44 through a refrigerant pipe 40*a* (to be described below) of the heat pump device 40.

The heat pump device 40 may allow air circulating in the care room 30 to be cooled, dehumidified, and heated. The heat pump device 40 may allow air flowing out of the care room 30 to be dehumidified, and allow the air heated through the condenser 43 to be introduced into the care room 30.

The duct 100 may include a first duct 101 positioned below the care room 30. The first duct 101 may be referred to as a lower duct 101. The duct 100 may form a passage that is connected to the air inlet 60 of the care room 30 and guides the air passing through the air inlet 60 to the blower fan 47. The duct 100 may include a second duct 102 provided on the left wall 12*c* and/or the right wall 12*d* forming the care room 30. The first duct 101 may be connected to the second duct 102 provided on the sidewall of the main body 10. The second duct 102 may be referred to as a side duct 102.

The second duct 102 may be provided on the outside of the sidewall of the inner case 12 in the second direction Y of the shoe care apparatus 1. One end of the second duct 102 may be connected to the at least one air outlet 31, and the other end of the second duct 102 may be connected to the first duct 101. The second duct 102 may form an exhaust passage 104 for guiding air to the air outlet 31.

In the first duct 101, the evaporator 42 and the condenser 43 may be arranged. The evaporator 42, the condenser 43, and the blower fan 47 may be arranged in the first direction X. The evaporator 42 may be located upstream of the condenser 43 based on the flow of air.

The blower fan 47 may be provided between the heat pump device 40 and the care room 30 to circulate air. The blower fan 47 may rotate based on a predetermined rotation per minute (RPM). Specifically, the blower fan 47 may suction air flowing into the first duct 101 and discharge the air toward the second duct 102. The air introduced into the first duct 101 through the air inlet 60 may be dried while passing through the evaporator 42 of the heat pump device 40, heated while passing through the condenser 43, and then discharged back to the care room 30 through the second duct 102 and the air outlet 31.

In addition, the deodorizing device 45 may be arranged in the first duct 101. The deodorizing device 45 may include a deodorizing filter 45*a* and an ultraviolet (UV) LED 45*b*. The deodorizing filter 45*a* and the UV LED 45*b* may be arranged at a position close to the air inlet 60 of the care room 30. The UV LED 45*b* may remove the smell of air by irradiating the deodorizing filter 45*a* with light. For example, the deodorizing filter 45*a* may include at least one of a ceramic filter, a photocatalytic filter, or an activated carbon filter.

The sterilizing device 49 may be further arranged in the care room 30 or in the first duct 101. The sterilizing device 49 may remove bacteria contained in the air. The sterilizing device 49 may include at least one of an ultraviolet lamp, an ultraviolet LED, a xenon lamp, an ozone generator, or a sterilizing agent spray.

A drain container 48 may be arranged on the lower side of the main body 10, that is, on the lower side of the machine room 32. The drain container 48 may store condensate water generated by the evaporator 42. That is, air discharged from the care room 30 may be cooled and dehumidified by the evaporator 42 provided in the duct 100, and condensate water generated during cooling and dehumidification may be collected in the drain container 48. The drain container 48 may be detachable from the main body 10. The drain container 48 may be referred to as a water collecting container 48.

At least one shelf 90 may be provided in the care room 30. Shoes may be placed on the shelf 90. In addition, the shelf 90 may include a duct shelf 91. The duct shelf 91 may form a duct passage 91*b* therein, and may be formed with a lower surface hole 91*a* at a lower surface thereof. Air blown from the blower fan 47 through the second duct 102 may be discharged into the care room 30 through the lower surface hole 91*a* of the duct shelf 91. In addition, the duct shelf 91 may be formed with an upper surface hole 93 at an upper surface thereof.

A side surface of the duct shelf 91 may be connected to a circular duct 92 arranged in the second duct 102. Air may be discharged into the care room 30 through a nozzle 92*a* of the circular duct 92. Air may be supplied to the duct shelf 91 after passing through the circular duct 92. The circular duct 92 may have various shapes.

The first temperature sensor 110 may measure a first temperature of air heated by the condenser 43. For example, the first temperature sensor 110 may be arranged downstream of the condenser 43 to detect the temperature of the air flowing out of the condenser 43. Hereinafter, the temperature of the air measured by the first temperature sensor 110 is defined as the first temperature. The first temperature sensor 110 may be provided in a passage between the condenser 43 and the blower fan 47. However, the position of the first temperature sensor 110 is not limited to the above example. The controller 200 of the shoe care apparatus 1 may adjust the operating frequency of the compressor 41 based on the first temperature measured by the first temperature sensor 110.

The second temperature sensor 120 may measure the temperature of air at the air inlet 60 of the care room 30 and/or the temperature of air before flowing into the evaporator 42. For example, the second temperature sensor 120 may be arranged upstream of the evaporator 42 to detect the temperature of the air before flowing into the evaporator 42. The second temperature sensor 120 may be provided in a passage between the air inlet 60 and the deodorization filter 45*a* or between the deodorization filter 45*a* and the evaporator 42. Hereinafter, the temperature of air measured by the second temperature sensor 120 is defined as the second temperature. The controller 200 of the shoe care apparatus 1 may determine external air temperature based on the second temperature measured by the second temperature sensor 120 when the shoe care apparatus 1 starts to operate.

Figure 4:
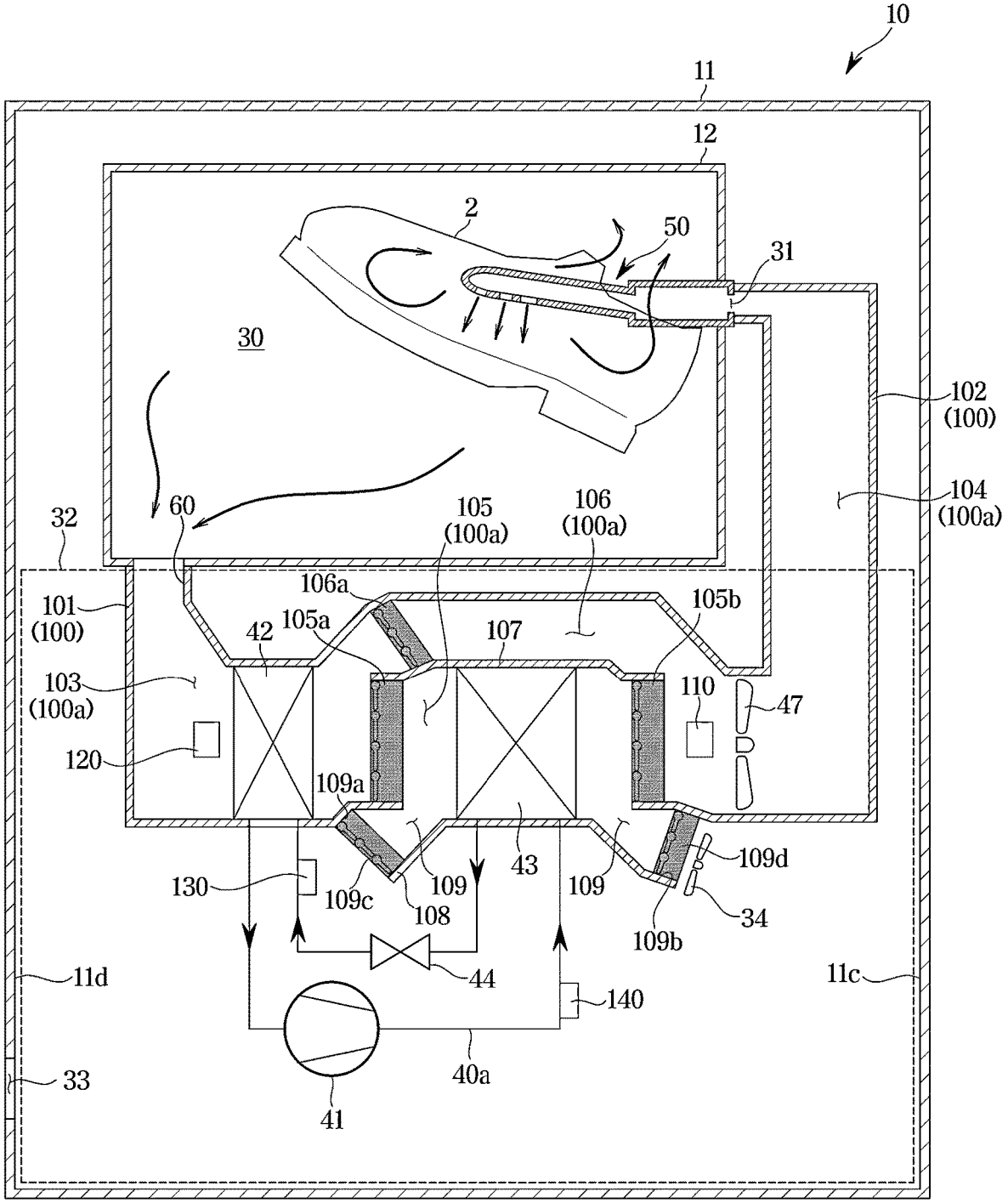
FIG. 4 is a schematic diagram illustrating the shoe care apparatus shown in FIG. 1.

FIG. 4 is a schematic diagram illustrating the shoe care apparatus shown in FIG. 1. In FIG. 4, a circulation passage circulating through the care room 30 and the machine room 32 in the shoe care apparatus 1 shown in FIG. 3 and the flow of air flowing through an internal passage 100*a* of the duct 100 will be described in detail.

Referring to FIG. 4, the shoe care apparatus according to the embodiment of the disclosure may include a circulation passage through which air circulates between the care room 30 and the machine room 32, and the blower fan 47 for blowing air in the circulation passage. The circulation passage may be a circulation path.

The circulation passage may include a first circulation passage and a second circulation passage. The first circulation passage may include an air supply passage 103, an air exhaust passage 104, and a first passage 105. The second circulation passage may include an air supply passage 103, an air exhaust passage 104, and a second passage 106.

In addition, the shoe care apparatus may include the duct 100 and the internal passage 100*a* provided at one side of the care room 30.

The duct 100 may include the first duct 101 and the second duct 102. The first duct 101 may be provided below the care room 30. The second duct 102 may be formed on the sidewalls 12*c* and 12*d* forming the care room 30. The first duct 101 and the second duct 102 may be connected to each other such that air communicates between each other. The first duct 101 and the second duct 102 may be integrally formed with each other. However, the disclosure is not limited thereto, and the first duct 101 and the second duct 102 may be separately formed and coupled to each other.

The duct 100 may include the passage 100*a* formed therein. The evaporator 42, the condenser 43, and the blower fan 47 may be arranged in the passage 100*a*. The passage 100*a* may be provided in plural. For example, the passage 100*a* may include the air supply passage 103, the air exhaust passage 104, the first passage 105, the second passage 106, and a third passage 109.

The air supply passage 103 may be provided such that air in the care room 30 flows into the duct 100. The air supply passage 103 may receive air from the air inlet 60 and allow the air to flow to the evaporator 42. The air inlet 60 may be formed on the lower surface 12*b* of the inner case forming the care room 30. The air supply passage 103 may be formed from the air inlet 60 to the evaporator 42. For example, the first passage 105 may be formed from the air inlet 60 to the upstream side of the evaporator 42. However, the disclosure is not limited thereto, and the evaporator 42 may be a component arranged inside the air supply passage 103.

The first passage 105 may be formed in the first duct 101. The first passage 105 may be provided such that air having passed through the evaporator 42 flows to the condenser 43. The first passage 105 may be formed from the evaporator 42 to the blower fan 47. For example, the first passage 105 may be formed from the downstream side of the evaporator 42 to the upstream side of the blower fan 47. However, the disclosure is not limited thereto, and the evaporator 42 and the blower fan 47 may be arranged in the first passage 105. The condenser 43 may be arranged inside the first passage 105. The first passage 105 may serve as a condenser passage 105 or a main passage 105. Therefore, low-temperature and low-humidity air that has passed through the evaporator 42 may pass through the condenser 43 and become high-temperature and low-humidity air. In addition, the first temperature sensor 110 may be arranged in the first passage 105. However, the position of the first temperature sensor 110 is not limited thereto.

The second passage 106 may be formed in the first duct 101. The second passage 106 may be separated from the first passage 105 by a partition wall 107. However, at least a portion of the second passage 106 may overlap the first passage 105. The second passage 106 may be provided such that the air having passed through the evaporator 42 bypasses the condenser 43. The second passage 106 may prevent the air having passed through the evaporator 42 from passing through the condenser 43 in a second mode to be described below. The second passage 106 may serve as a bypass passage 106. Due to the bypass passage 106, the air passing through the evaporator 42 in the duct 100 may not pass through the condenser 43, and the temperature of the care room 30 in which heat accumulation has occurred and surrounding components may be lowered. Accordingly, the dehumidification efficiency of the evaporator 42 may be increased.

The third passage 109 may be formed by the first duct 101. For example, the third passage 109 may be formed by a third passage forming portion 108 protruding toward the machine room 32. The third passage 109 may allow air inside the machine room 32 to flow to the condenser 43. The third passage 109 may allow air in the machine room 32 to pass through the condenser 43 in the second mode to be described below. At least a portion of the third passage 109 may overlap the first passage 105. Due to the third passage 109, air in the machine room 32 may heat-exchange with the condenser 43, and the heated air in the machine room 32 may pass through the communication hole 33 provided in the rear wall of the main body 10 to communicate or heat-exchange with the outside air of the shoe care apparatus 1. Accordingly, the heat in the shoe care apparatus 1 may be discharged to the outside of the shoe care apparatus 1.

The air exhaust passage 104 may be formed in the duct 100. A portion of the exhaust passage 104 may be formed in the second duct 102. The air exhaust passage 104 may be provided such that air in the duct 100 flows to the care room 30 in which shoes 2 are accommodated. The air exhaust passage 104 may be connected to the air outlet 31 such that the air having passed through the blower fan 47 flows to the care room 30. The air outlets 31 may be formed in the sidewalls 12*c* and 12*d* of the inner case forming the care room 30. The air exhaust passage 104 may be formed from the blower fan 47 to the air outlet 31. For example, the first passage 105 may be formed from the downstream side of the blower fan 47 to the air outlet 31. However, the disclosure is not limited thereto, and the blower fan 47 may be a component arranged inside the exhaust passage 104.

The shoe care apparatus may include dampers 105*a*, 105*b*, 106*a*, 109*c*, and 109*d* to open and close the passage 100*a*. The dampers may be referred to as valves 105*a*, 105*b*, 106*a*, 109*c*, and 109*d*. A plurality of dampers 105*a*, 105*b*, 106*a*, 109*c*, and 109*d* may be provided. For example, the plurality of dampers 105*a*, 105*b*, 106*a*, 109*c*, and 109*d* include the first damper 106*a*, the second damper 109*c*, the third damper 109*d*, the fourth damper 105*a*, and the fifth damper 105*b*.

The first damper 106*a* may be arranged in the bypass passage 106 to adjust the flow rate of air flowing through the bypass passage 106. The first damper 106*a* may open and close the bypass passage 106. However, the position of the first damper 106*a* is not limited to the above example, and the first damper 106*a* may be arranged outside the bypass passage 106 as long as it can open and close the bypass passage 106.

The second damper 109*c* and the third damper 109*d* may open and close the third passage 109 to adjust the flow rate of air flowing through the third passage 109. For example, the second damper 109*c* may open and close an inlet 109*a* of the third passage 109, and the third damper 109*d* may open and close an outlet 109*b* of the third passage 109. The second damper 109*c* and/or the third damper 109*d* may close the third passage 109 such that air in the machine room 32 does not pass through the condenser 43 in the first mode and/or the normal mode, and may open the third passage 109 such that air in the machine room 32 passes through the condenser 43 in the second mode. Due to the third passage 109, the air in the machine room 32 may heat-exchange with the condenser 43, and the heated air in the machine room 32 may pass through the communication hole 33 provided in the rear wall of the main body 10 to communicate or heat-exchange with the outside air of the shoe care apparatus 1. Accordingly, the heat in the shoe care apparatus 1 may be discharged to the outside of the shoe care apparatus 1.

The fourth damper 105*a* and the fifth damper 105*b* may open and close the first passage 105 to adjust the flow rate of air flowing through the first passage 105. The fourth damper 105*a* may be arranged upstream of the condenser 43 in the first passage 105. For example, the fourth damper 105*a* may be arranged downstream of the evaporator 42 and upstream of the condenser 43 to adjust the flow rate of air in the first passage 105 that flows through the evaporator 42 to the condenser 43. The fifth damper 105*b* may be arranged downstream of the condenser 43 in the first passage 105. For example, the fifth damper 105*b* may be arranged downstream of the condenser 43 and upstream of the blower fan 47 to adjust the flow rate of air in the first passage 105 that flows through the condenser 43 to the blower fan 47.

The fourth damper 105*a* and/or the fifth damper 105*b*, in the first mode and/or in the normal mode, may open the first passage 105 such that air introduced from the care room 30 into the air supply passage 103 through the air inlet 60 flows to the condenser 42. In, addition, the fourth damper 105*a* and/or the fifth damper 105*b*, in the second mode, may close the first passage 105 such that air introduced from the care room 30 into the air supply passage 103 through the air inlet 60 does not flow into the condenser 42, and may allow the air in the machine room 32 to flow from the inlet 109*a* of the third passage 109 to the condenser 42 and then to the outlet 109*b* of the third passage 109.

Due to the third passage 109, the air in the machine room 32 may heat-exchange with the condenser 43, and the heated air in the machine room 32 may pass through the communication hole 33 provided in the rear wall of the main body 10 to communicate or heat-exchange with the outside air of the shoe care apparatus 1. Accordingly, the heat in the shoe care apparatus 1 may be discharged to the outside of the shoe care apparatus 1.

The machine room 32 may be provided below the care room 30. The refrigerant pipe 40*a*, the compressor 41, and the expander 44 constituting the heat pump device 40 may be arranged in the machine room 32. In addition, the shoe care apparatus 1 may include a third temperature sensor 130 and a fourth temperature sensor 140. The third temperature sensor 130 and the fourth temperature sensor 140 may be arranged adjacent to the refrigerant pipe 40*a* to detect the temperature of the refrigerant. For example, the third temperature sensor 130 may detect the temperature of the refrigerant flowing into the evaporator 42 by passing through the expander 44. The fourth temperature sensor 140 may detect the temperature of the refrigerant flowing into the condenser 43 by passing through the compressor 41.

The shoe care apparatus 1 may include the communication hole 33 for communicating the outside of the main body 10 with the inside of the main body 10. The communication hole 33 may be formed in one wall of the main body 10 such that air from the outside of the main body 10 flows into or out of the machine room 32. For example, referring to FIG. 4, the communication hole 33 may be formed in the right wall 11*d* and/or the rear wall 11*e* of the outer cabinet 11. In the drawings, the communication hole 33 is illustrated as being formed in the right wall 11*d* for the sake of convenience of description, but the position of the communication hole 33 is not limited to that shown in the drawings.

The shoe care apparatus 1 may further include a condenser cooling fan 34. The condenser cooling fan 34 may blow air in the third passage 109. For example, the condenser cooling fan 34 may allow the air in the machine room 32 to flow to the condenser 43 and then to the machine room 32 again. The condenser cooling fan 34 may be arranged in the machine room 32. For example, the condenser cooling fan 34 may be arranged downstream of the outlet 109*b* of the third flow passage 109. However, the disclosure is not limited thereto, and the condenser cooling fan 34 may be arranged at various positions, such as at the inlet 109*a* of the third flow passage 109.

Figure 5:
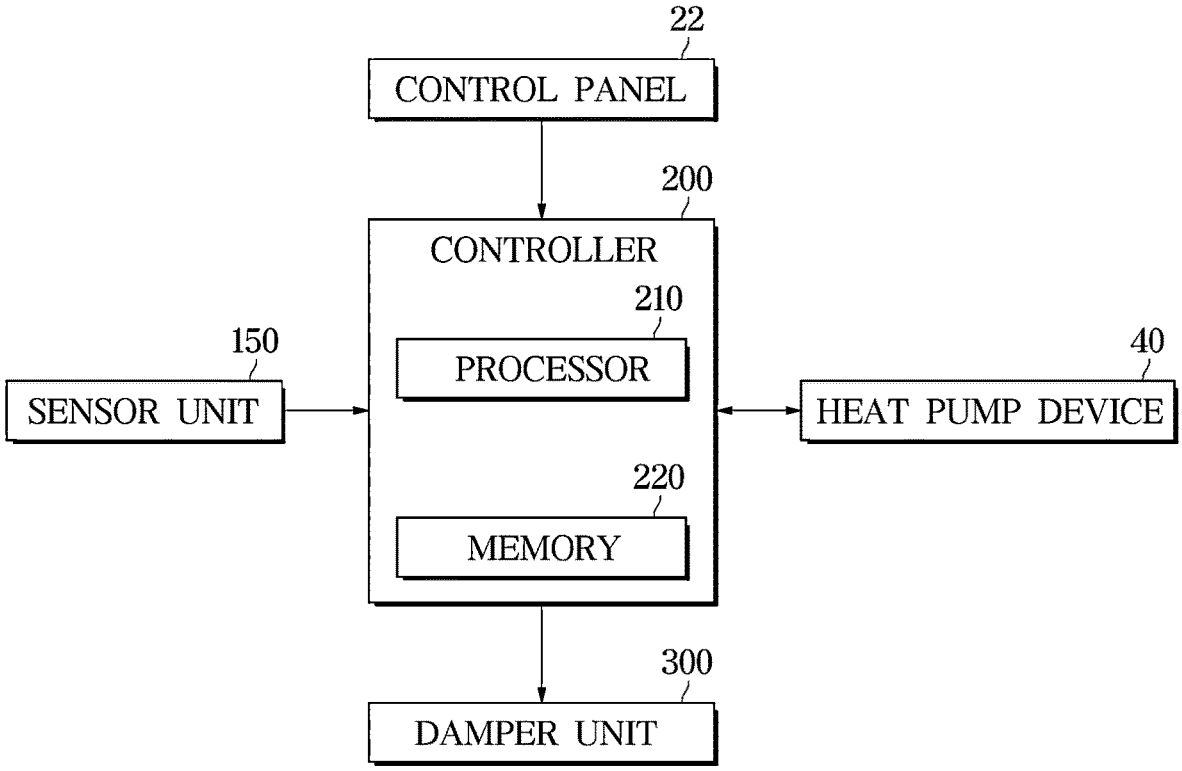
FIG. 5 is a control block diagram illustrating a shoe care apparatus according to an embodiment.

FIG. 5 is a control block diagram illustrating a shoe care apparatus according to an embodiment.

Referring to FIG. 5, a shoe care apparatus 1 according to an embodiment may include a control panel 22, a heat pump device 40, a sensor unit 150, a controller 200, and a damper unit 300. As described above, the control panel 22 may include at least one of a button or a touch screen, and may receive various commands from a user.

The control panel 22 may transmit a command (hereinafter, 'a user input') received from the user to the controller 200.

The heat pump device 40 may include a compressor 41, an evaporator 42, a condenser 43, and an expander 44. The heat pump device 40 may transmit operation information (e.g., an operating frequency of the compressor 41) to the controller 200, and the controller 200 may control the heat pump device 40.

According to various embodiments, the controller 200 may control the operating frequency of the compressor 41.

The sensor unit 150 may detect a temperature at each location (e.g., inside the duct 100) of the shoe care apparatus 1.

For example, the sensor unit 150 according to an embodiment may include at least one of a first temperature sensor 110, a second temperature sensor 120, a third temperature sensor 130, or a fourth temperature sensor 140.

The sensor unit 150 may detect the temperature at each location of the shoe care apparatus 1 and transmit a signal to the controller 200.

The damper unit 300 may include a plurality of dampers (e.g., a first damper 106*a*, a second damper 109*c*, a third damper 109*d*, a fourth damper 105*a*, and a fifth damper 105*b*) to adjust the flow rate of air flowing through a plurality of passages (e.g., a first passage 105, a second passage 106, and a third passage 109) provided in the duct 100.

According to various embodiments, the controller 200 may control opening/closing of at least one damper (e.g., the first damper 106*a*) among the plurality of dampers included in the damper unit 300.

The controller 200 may include at least one processor 210 and at least one memory 220, and may control at least one other component of the shoe care apparatus 1.

The processor 210 may execute software (e.g., a program) to control at least one other component (e.g., the heat pump device 40, the damper unit 300, the blower fan 47, the deodorizing device 45, the condenser cooling fan 34) of the shoe care apparatus 1 connected to the processor 210, and perform various data processing or calculations. As a part of the data processing or calculations, the processor 210 may store instructions or data received from other components (e.g., the sensor unit 150 and the control panel 22) in a volatile memory, process the instructions or data stored in the volatile memory, and store the result data in a non-volatile memory. According to an embodiment, the processor 210 may include a main processor (e.g., a central processing unit) or an auxiliary processor (e.g., a processor for controlling a heat pump device and a processor for controlling a damper unit) that may be operated independent of or together with the main processor. For example, when the processor 210 includes a main processor and an auxiliary processor, the auxiliary processor may be set to use less power than the main processor or specialize in a specified function. The auxiliary processor may be implemented separately from or as a part of the main processor.

The memory 220 may store various pieces of data used by at least one component (e.g., the processor 210 or the sensor unit 150) of the shoe care apparatus 1. The data may include, for example, software, and input data or output data regarding instructions related to the software. The memory 220 may include a volatile memory or a non-volatile memory.

According to various embodiments, the memory 220 may store software (e.g., a program) that, when executed by the processor 210, performs an operation to be described below.

In the above, the configuration and structure of the shoe care apparatus 1 according to various embodiments has been described, and hereinafter, a method of controlling the shoe care apparatus 1 according to various embodiments will be described in detail.

Figure 6:
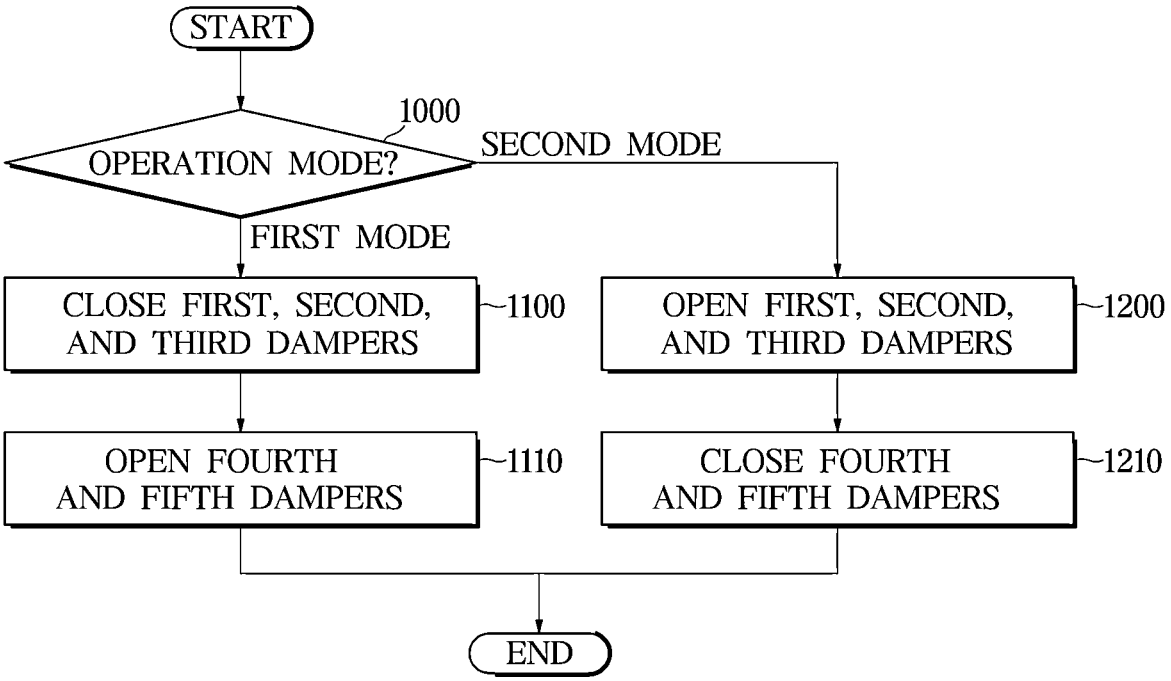
FIG. 6 is a flowchart showing a method of controlling a damper for each operation mode of a shoe care apparatus according to an embodiment.
Figure 7:
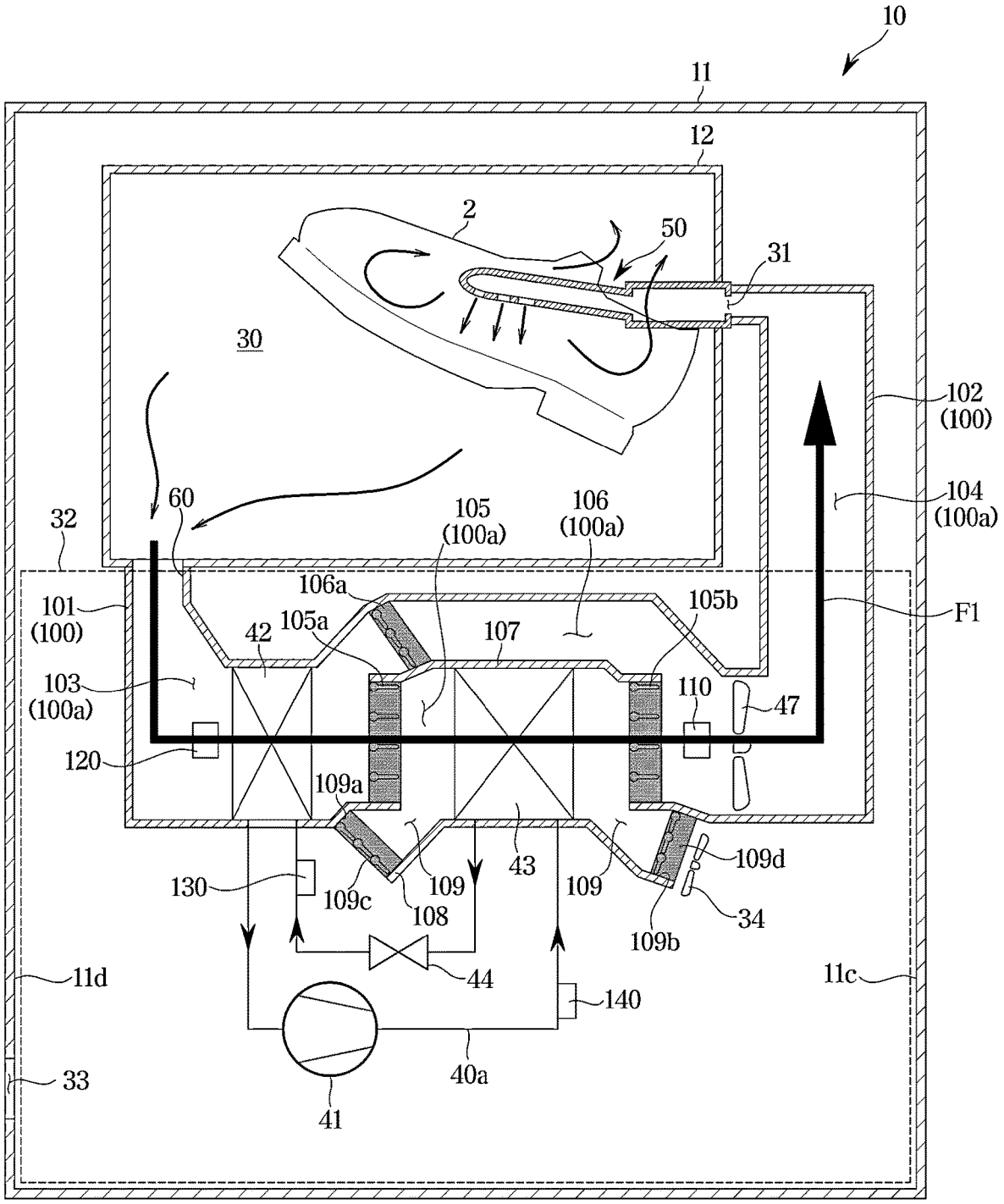
FIG. 7 illustrates a flow of air when a shoe care apparatus according to an embodiment operates in the first operation mode.
Figure 8:
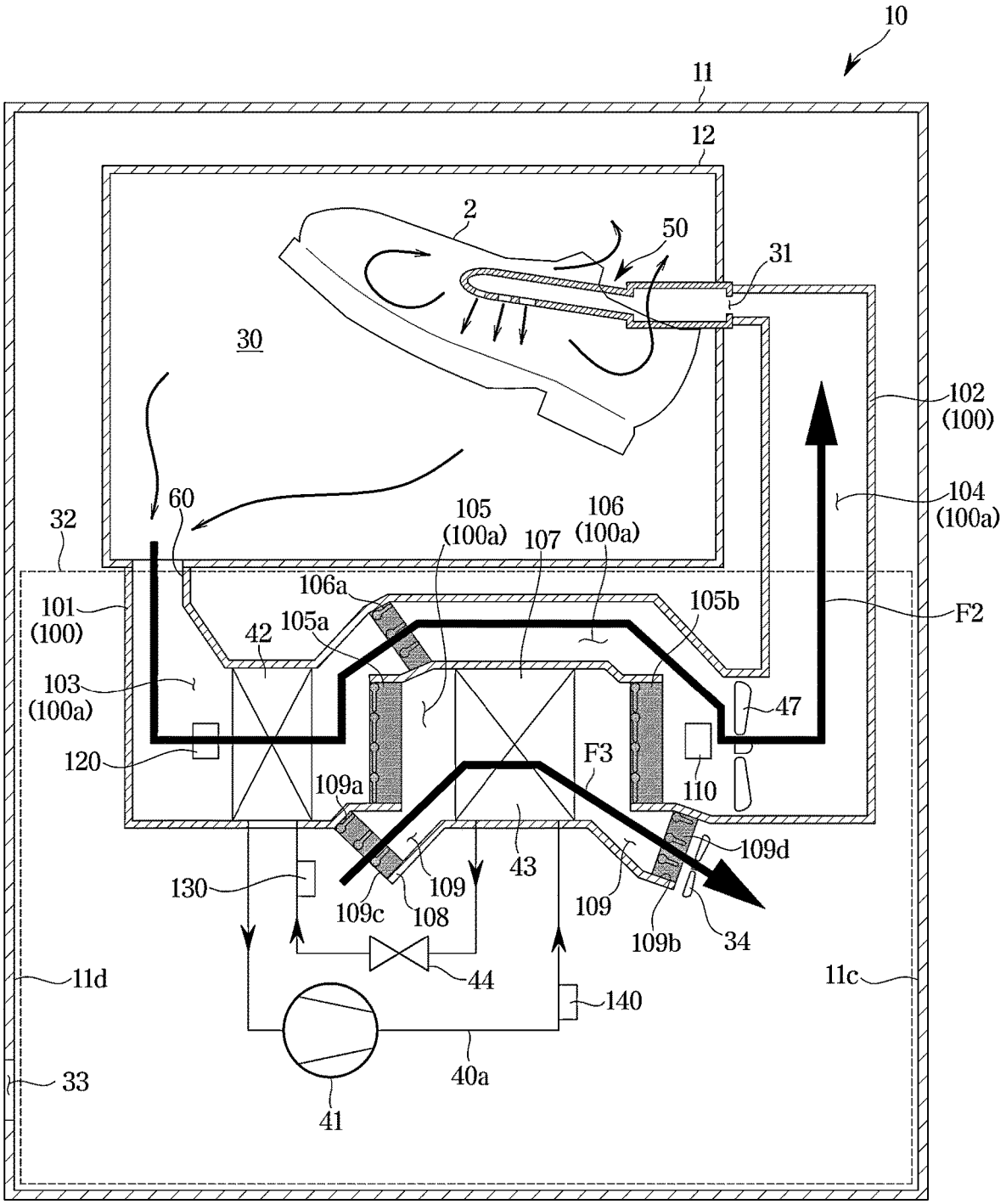
FIG. 8 illustrates a flow of air when a shoe care apparatus according to an embodiment operates in the second operation mode.

FIG. 6 is a flowchart showing a method of controlling a damper for each operation mode of a shoe care apparatus according to an embodiment, FIG. 7 illustrates a flow of air when a shoe care apparatus according to an embodiment operates in the first operation mode, and FIG. 8 illustrates a flow of air when a shoe care apparatus according to an embodiment operates in the second operation mode.

Referring to FIG. 6, the controller 200 may control various components (e.g., the damper unit 300 and the heat pump device 40) of the shoe care apparatus 1 based on an operation mode of the shoe care apparatus 1 (1000).

According to various embodiments, the controller 200 may control opening and closing of the damper unit 300 (e.g., the first damper 106*a*, the second damper 109*c*, and the third damper 109*d*, the fourth damper 105*a*, and the fifth damper 105*b*) based on the operation mode of the shoe care apparatus 1.

The operation mode of the shoe care apparatus 1 may include a first operation mode and a second operation mode.

The first operation mode may refer to an operation mode for drying the shoes 2 accommodated in the care room 30 with high-temperature air that has passed through the condenser 43.

The second operation mode may refer to an operation mode for cooling the shoes 2 accommodated in the care room 30 with relatively low temperature air that has not passed through the condenser 43, and cooling the heat pump device 40 (e.g., the condenser 43).

Referring to FIG. 7, in an embodiment, the controller 200 may close the first damper 106*a*, the second damper 109*c*, and the third damper 109*d* in the first mode (1100).

In the embodiment, the controller 200 may open the fourth damper 105*a* and the fifth damper 105*b* in the first mode (1110).

According to various embodiments, the controller 200 may operate the blower fan 47 and stop the operation of the condenser cooling fan 34 in the first mode.

Referring to the flow of air F1 shown in FIG. 7, when the first damper 106*a*, the second damper 109*c*, and the third damper 109*d* are closed, and the fourth damper 105*a* and the fifth damper 105*b* are opened, the air introduced from the care room 30 and passed through the evaporator 42 may pass through the condenser 43 and then flow back into the care room 30.

According to the embodiment, in the first mode, air heated through the condenser 43 may be provided to the shoe 2 to dry the shoe 2 efficiently.

According to various embodiments, the controller 200 may close only one (e.g., the first damper 106*a*) of the first damper 106*a*, the second damper 109*c*, and the third damper 109*d* in the first mode.

Referring to FIG. 8, air outside the main body 10 and air inside the main body 10 may communicate with each other through the communication hole 33. For example, air outside the main body 10 may flow into or out of the machine room 32.

In one embodiment, the controller 200 may open the first damper 106*a*, the second damper 109*c*, and the third damper 109*d* in the second mode (1200).

In the embodiment, the controller 200 may close the fourth damper 105*a* and the fifth damper 105*b* in the second mode (1210).

According to various embodiments, the controller 200 may operate the blower fan 47 and the condenser cooling fan 34 in the second mode. In addition, the controller 200 may operate the compressor 41 at the minimum operating frequency in the second mode.

Referring to the first flow of air F2 shown in FIG. 8, the first damper 106*a*, the second damper 109*c*, and the third damper 109*d* are opened, and the fourth damper 105*a* and the fifth damper 105*b* are closed, the air introduced from the care room 30 and passed through the evaporator 42 may bypass the condenser 43 and flow back into the care room 30 through the second passage 106.

Referring to the second flow of air F3 shown in FIG. 8, when the first damper 106*a*, the second damper 109*c*, and the third damper 109*d* are opened, and the fourth damper 105*a* and the fifth damper 105*b* are opened, air introduced into the machine room 32 through the communication hole 33 may flow into the third passage 109 from the inlet 109*a*, and the air that has passed through the condenser 43 may flow back into the machine room 32 through the outlet 109*b*. The air flowing back into the machine room 32 through the outlet 109*b* may flow out of the main body 10 through the communication hole 33.

According to an embodiment, in the second mode, the shoe 2 may be cooled by circulating the air that has passed through only the evaporator 42 into the care room 30.

In addition, according to the embodiment, in the second mode, when the target temperature is not maintained and rises despite the compressor 41 operating at the minimum operating frequency, unheated air in the machine room 32 may be used to cool the condenser 43.

According to various embodiments, the controller 200 may open the fourth damper 105*a* and the fifth damper 105*b* in the second mode, and in this case, the shoe 2 and the condenser 43 may be cooled with a lower efficiency.

Figure 9:
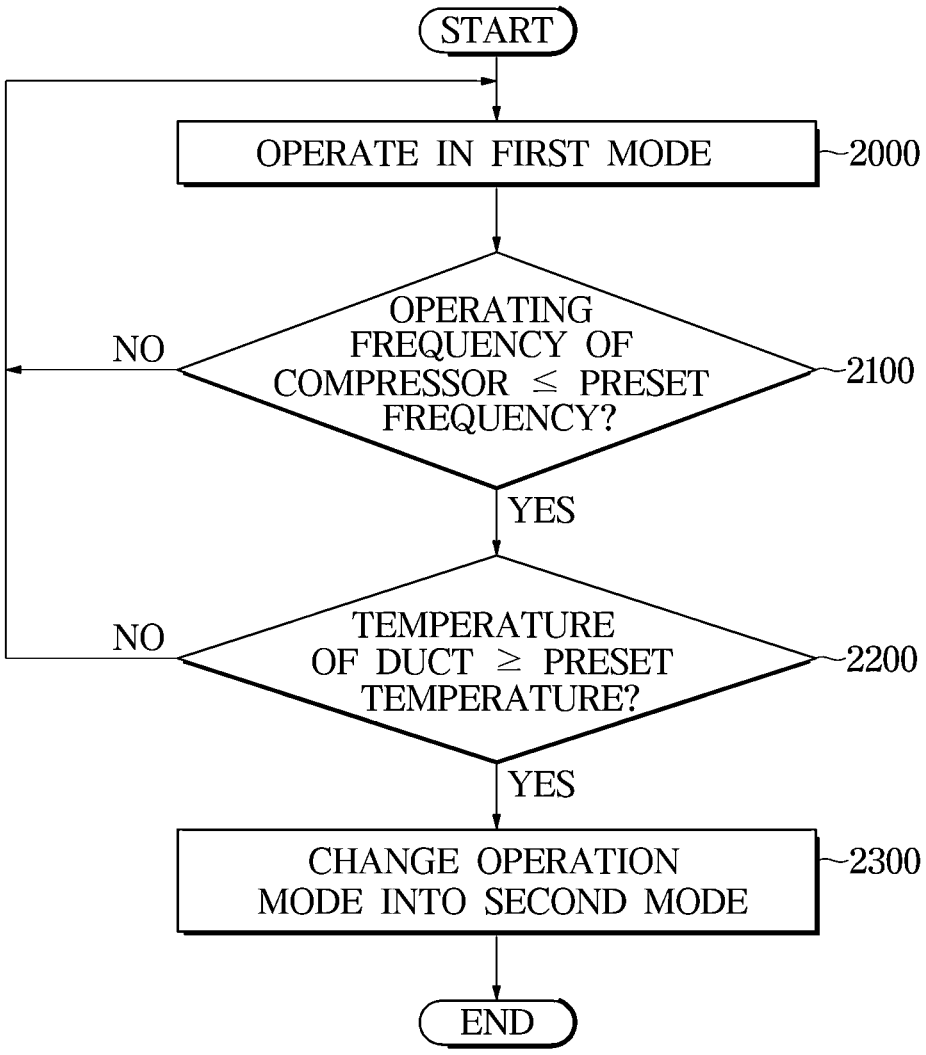
FIG. 9 is a flowchart showing a method of changing an operation mode by a shoe care apparatus according to an embodiment.

FIG. 9 is a flowchart showing a method of changing an operation mode by a shoe care apparatus according to an embodiment.

Referring to FIG. 9, the shoe care apparatus 1 according to an embodiment may operate in a first mode (2000).

According to various embodiments, in response to a user starting by selecting a drying course through the control panel 22, the controller 200 may control the damper unit 300 and the heat pump device 40 such that the shoe care apparatus 1 operates in the first mode.

In an embodiment, the controller 200 may adjust the operating frequency of the compressor 41 or control on/off operations of the compressor 41 to follow a target temperature corresponding to the drying course on the basis of temperature information acquired through the sensor unit 150.

For example, the controller 200 may adjust the operating frequency of the compressor 41 through a fuzzy control method to follow a target temperature corresponding to a drying course.

Meanwhile, despite the compressor 41 being operated at a preset frequency (e.g., the minimum operating frequency), when the temperature of the shoe care apparatus 1 (e.g., the temperature inside the duct 100 or the temperature inside the care room 30) continuously rises due to a special circumstance (e.g., high-temperature outside air), the dehumidifying performance of the shoe care apparatus 1 may be deteriorated due to high temperature and high humidity air, and a failure of the heat pump device 40 may be caused.

In an embodiment, the controller 200 may determine the operation mode of the shoe care apparatus 1 based on the operating frequency of the compressor 41 and the temperature inside the duct 100.

Specifically, the controller 200, based on the operating frequency of the compressor 41 being less than or equal to a preset frequency (YES in operation 2100) and the temperature inside the duct 100 being higher than or equal to a set temperature (YES in operation 2200) while the shoe care apparatus 1 operates in the first mode, may change the operation mode of the shoe care apparatus 1 to the second mode (2300).

According to an embodiment, despite the compressor 41 being operating at a preset frequency (e.g., the minimum operating frequency), when the temperature of the shoe care apparatus 1 (e.g., the temperature inside the duct 100 or the temperature inside the care room 30) continuously rises due to a special circumstance (e.g., high-temperature outside air), the operation mode of the shoe care apparatus 1 may be switched to the second mode to cool the condenser 43 and the shoes 2.

In addition, according to the embodiment, by changing the operation mode of the shoe care apparatus 1 from the first mode to the second mode, the high-temperature and high-humidity air circulating inside the care room 30 may be changed to low-temperature and low-humidity air, and accordingly the dehumidification performance may be improved.

Figure 10:
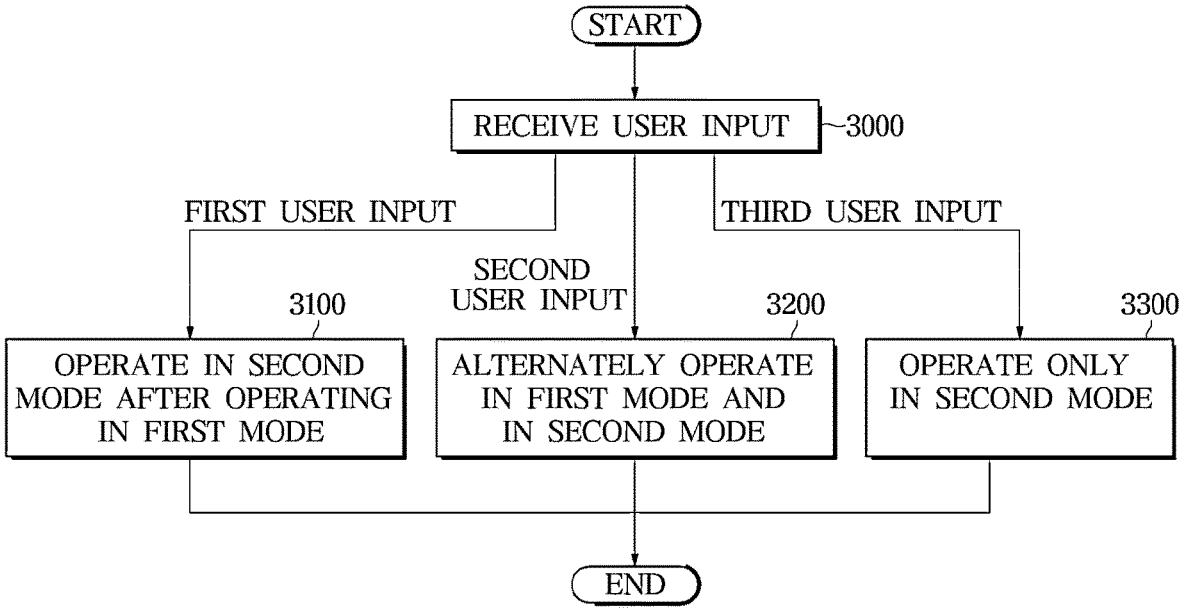
FIG. 10 is a flowchart showing a method of operating a shoe care apparatus based on a user input according to an embodiment.

FIG. 10 is a flowchart showing a method of operating a shoe care apparatus based on a user input according to an embodiment.

Referring to FIG. 10, the shoe care apparatus 1 according to an embodiment may include the control panel 22 to receive various user inputs from a user.

The shoe care device 1 according to an embodiment may provide a user with various shoe care courses, and the user may select a shoe care course using various buttons and a touch pad included in the control panel 22.

In various embodiments, the shoe care apparatus 1 may provide general drying courses for drying the shoes 2, and may provide various courses, such as a first course for drying and then cooling the shoes 2, a second course for focusing on dehumidification of the shoes 2, and a third course for cooling the shoe 2.

Hereinafter, for the sake of convenience of description, a user input for selecting the first course is defined as a first user input, a user input for selecting the second course is defined as a second user input, and a user input for selecting the third course is defined as a third user input.

In an embodiment, the controller 200 may receive a user input through the control panel 22 (3000), and operate the shoe care apparatus 1 in one of the first mode and the second mode based on the user input.

According to various embodiments, the controller 200, based on the first user input being received, may control the shoe care apparatus 1 to operate in the first mode for a first preset time and then operate in the second mode for a second preset time (3100).

In an embodiment, the first preset time may be set as a time for drying the shoe 2, and the second preset time may be set as a time for cooling the shoe 2. In addition, by considering that the time for drying the shoe 2 is longer than the time for cooling the shoe 2, the first preset time may be set longer than the second preset time.

The shoe care apparatus 1 according to the embodiment may provide the user with the first course, so that when the user wears the shoes 2 immediately after the care has been completed, the user may feel a cooler feeling, thereby increasing the user's satisfaction.

For example, the first course may be mainly used in summer when the user is uncomfortable to wear the shoes 2 with high temperature.

According to various embodiments, the controller 200 may control the shoe care apparatus 1 to alternately operate in the first mode and the second mode for a preset number of times based on reception of the second user input (3200).

In an embodiment, the controller 200 may repeat a cycle several times in which the shoe care apparatus 1 operates in the first mode for a first reference time and operates in the second mode for a second reference time. In this case, the first reference time and the second reference time may be preset to a time for maximizing the dehumidification performance.

When the shoe care apparatus 1 operates alternately in the first mode and the second mode, air that has been heated and humidified by passing through the care room 30, the evaporator 42, and the condenser 43 in the first mode may be caused to pass through only the evaporator 42 in the second mode so that the air may come to have a lowered humidity, and in the next first mode, high temperature and low humidity air may be supplied to the shoes 2, so that the moisture of the shoes 2 may be efficiently removed.

The shoe care apparatus 1 according to the embodiment may provide the user with the second course to thereby remove moisture from the shoes 2 with an optimal time According to various embodiments, the controller 200 may control the shoe care apparatus 1 to operate only in the second mode based on receiving the third user input (3300).

In an embodiment, the controller 200 may control the shoe care apparatus 1 to operate in the second mode for a preset time. In this case, the preset time may be set in advance as a time suitable for cooling the shoe 2.

When the shoe care apparatus 1 operates only in the second mode, only low-temperature air may be provided to the shoe 2, so that the shoe 2 may be efficiently cooled in an optimal time.

The shoe care apparatus 1 according to the embodiment provides the user with the third course, so that when the user wears the shoes 2, the user feels cool, thereby increasing the user's satisfaction.

For example, the third course may be mainly used in summer when the user is uncomfortable to wear shoes 2 with high temperature.

According to various embodiments, the shoe care apparatus 1 may provide the user with various courses by appropriately using the first mode and the second mode, thereby improving the user's satisfaction.

Although embodiments of the disclosure have been described with reference to the accompanying drawings, a person having ordinary skilled in the art will appreciate that other specific modifications may be easily made without departing from the technical spirit or essential features of the application. Therefore, the foregoing embodiments should be regarded as illustrative rather than limiting in all aspects.

DESCRIPTION OF REFERENCE NUMERALS

1; shoe care apparatus
10; main body
32; machine room
40; heat pump device
41; compressor
42; evaporator
43; condenser

100; duct
100*a*; passage
101; first duct
102; second duct
103; air supply passage
104; air exhaust passage
105; first passage
106; second passage
109; third passage
150: sensor unit
200: controller
210: processor
220: memory
300: damper unit

What is claimed is:

1. A shoe care apparatus comprising:
a main body;
a first compartment in the main body and configured to accommodate shoes;
a second compartment in the main body and configured to accommodate a heat pump including an evaporator and a condenser;
a fan configured to circulate air through the first compartment and the second compartment;
a first circulation passage configured to guide air discharged from the first compartment back to the first compartment by guiding the discharged air to the evaporator and the condenser;
a second circulation passage to guide the discharged air from the first compartment back to the first compartment by guiding the discharged air to the evaporator and bypassing the condenser; and
a first valve configured to open and close the second circulation passage.

2. The shoe care apparatus of claim 1, further comprising:
a communication hole formed in a wall of the main body to communicate an outside of the main body with the second compartment;
an inlet through which air introduced into the second compartment through the communication hole flows to the condenser; and
an outlet formed through which the air introduced through the inlet passes through the condenser and then flows to the second compartment and in which air discharged through the outlet is discharged to the outside of the main body through the communication hole.

3. The shoe care apparatus of claim 2, further comprising at least one of a second valve configured to open and close the inlet or a third valve configured to open and close the outlet.

4. The shoe care apparatus of claim 1, further comprising a fourth valve arranged between the evaporator and the condenser on the first circulation passage.

5. The shoe care apparatus of claim 4, further comprising a controller configured to control an operation of the first valve and an operation of the fourth valve.

6. The shoe care apparatus of claim 5, wherein the controller is configured to:
control the operation of the first valve and the operation of the fourth valve such that the second circulation passage is closed when the first circulation passage is opened; and
control the operation of the first valve and the operation of the fourth valve such that the second circulation passage is opened when the first circulation passage is closed.

7. The shoe care apparatus of claim 5, wherein the controller is configured to
control the operation of the first valve and the operation of the fourth valve based on at least one of an operating frequency of a compressor of the heat pump or a temperature of air supplied to the first compartment.

8. The shoe care apparatus of claim 7, further comprising
a communication hole formed in a wall of the main body to communicate an outside of the main body with the second compartment;
an inlet through which air introduced into the second compartment through the communication hole flows to the condenser; and
an outlet formed through which the air introduced through the inlet passes through the condenser and then flows to the second compartment and in which air discharged through the outlet is discharged to the outside of the main body through the communication hole; and
at least one of a second valve configured to open and close the inlet or a third valve configured to open and close the outlet,
wherein the controller is configured to control the operation of the second valve and the operation of the third valve based on the temperature of the air supplied to the first compartment.

9. A method of controlling a shoe care apparatus that operates in a first mode in which air passed through a condenser of a heat pump is supplied to a compartment and a second mode in which air bypassed the condenser is supplied to the compartment, the method comprising:
in response to the shoe care apparatus operating in the first mode, opening a first circulation passage to guide air discharged from the compartment back to the compartment by guiding the discharged air to an evaporator of the heat pump and the condenser; and
in response to the shoe care apparatus operating in the second mode, opening a second circulation passage to guide air discharged from the compartment back to the compartment by guiding the discharged air to the evaporator and bypassing the condenser.

10. The method of claim 9, further comprising determining an operation mode of the shoe care apparatus based on at least one of an operating frequency of a compressor and a temperature of air supplied to the compartment.

11. The method of claim 10, wherein the determining of an operation mode of the shoe care apparatus based on at least one of an operating frequency of the compressor and a temperature of air supplied to the compartment includes
based on the operating frequency of the compressor being less than or equal to a preset frequency and the temperature of air supplied to the compartment being higher than or equal to a set temperature, while the shoe care apparatus is operating in the first mode, changing the operation mode of the shoe care apparatus into the second mode.

12. The method of claim 9, further comprising operating the shoe care apparatus in one of the first mode or the second mode based on a user input.

13. The method of claim 12, wherein the operating of the shoe care apparatus in one of the first mode and the second mode based on the user input includes
based on a first user input being received, controlling the shoe care apparatus to operate in the first mode for a first preset time and then operate in the second mode for a second preset time.

14. The method of claim 12, wherein the operating of the shoe care apparatus in one of the first mode and the second mode based on the user input includes based on a first user input being received, controlling the shoe care apparatus to alternately operate in the first mode and in the second mode.

15. The method of claim 12, wherein the operating of the shoe care apparatus in one of the first mode and the second mode based on the user input includes based on a first user input being received, controlling the shoe care apparatus to operate only in the second mode for a preset time.

* * * * *